US005787606A

United States Patent [19]

Bokholdt

[11] Patent Number: 5,787,606

[45] Date of Patent: Aug. 4, 1998

[54] FABRIC SOFTNER SHEET DISPENSER

[76] Inventor: Timothy A. Bokholdt, 1805 Arbor La. Apt. 313, Crest Hill, Ill. 60435

[21] Appl. No.: 847,969

[22] Filed: Mar. 18, 1997

[51] Int. Cl.[6] ..... F26B 13/10; F26B 19/00

[52] U.S. Cl. ..... 34/527; 34/556; 34/573; 34/61

[58] Field of Search ..... 34/60, 61, 90, 34/525, 526, 527, 534, 556, 573; 68/12.5, 20, 58; 206/409, 812, 818

[56] References Cited

U.S. PATENT DOCUMENTS

| | | | |
|---|---|---|---|
| 3,267,701 | 8/1966 | Mandarino | 34/60 X |
| 5,020,240 | 6/1991 | Lee | 34/60 |
| 5,072,526 | 12/1991 | Hirota et al. | 34/60 |
| 5,533,621 | 7/1996 | Schoal, Jr. | 206/409 |
| 5,604,992 | 2/1997 | Robinson | 34/90 |

*Primary Examiner*—Henry A. Bennett
*Assistant Examiner*—Steve Gravini

[57] ABSTRACT

A clothes dryer fabric softener sheet dispenser with a fabric softener sheet dispenser mounted on a door of a clothes dryer, a filling chamber in the dispenser for holding a roll of fabric softener sheets, a sheet guide inside the filling chamber guiding the sheets away from the filling chamber, a pair of electric motors allowing the driving of the sheets away from the sheet guide and allowing the driving of the sheets away from the filling chamber toward a dryer compartment of the clothes dryer. The clothes dryer fabric softener sheet dispenser also has belts for engaging the sheets driven from the sheet guide in order to facilitate movement toward the dryer compartment. Other features are entry rollers at an engaging sheet guide end connected to the belts and driven by the electric motors, exit rollers at an outlet end adjacent to the dryer compartment connected to the belts and driven by the electric motors via the belts, a cutter allowing the fabric softener sheet to enter the dryer compartment and tumble with a circulating air flow inside the clothes dryer.

1 Claim, 2 Drawing Sheets

FABRIC SOFTNER SHEET DISPENSER

BACKGROUND OF THE INVENTION

Residential and commercial dryers are widely used machines in the U.S. and other countries. Although automatic dryers have drawbacks they can leave clothes wrinkly, with a mildew smell and full of static electricity. In return they would have to be ironed or washed over.

Thus its desirable to provide a dryer with a method or device that permeates a wrinkle free, fresh scent, and a anti static device. This invention generally relates to an automatic fabric softener sheet dispenser for an automatic dryer.

The market for fabric softener is used in many various ways. This invention is different from all others because there are no messy liquids or additives involved.

BACKGROUND OF THE INVENTION (part 2)

For example, the trademark "Downey®", "Downey®" is a liquid additive that is added to the washing process.

This invention will save time because an individual will not have to add a fabric softener every time they wash or dry their clothes. In the past with other devices a person may worry if they added such needed elements to process. For example, in the washer where the fabric softener should be added at a specific time of the process. This invention simply adds a new roll to the filling chamber and this apparatus will automatically dispense a single sheet to the dryers compartment. This device will save time for clean up from adding softeners or other elements every time you use a machine.

In the past many devices for drying clothes have been designed U.S. Pat. Nos. 3,267,701, 4,647,908, 4,891,890, 4,934,563, 5,020,240, 5,040,311, 5,193,670 are all patent numbers that pertain to adding clothes with said liquid elements and sprays. The invention for a fabric softener sheet dispenser is different from all other known patents.

FABRIC SOFTENER SHEET DISPENSER

Summary of Invention

The Invention of a Fabric Softener sheet dispenser for an electric or gas automatic Clothing Dryer that dispenses a single sheet of Fabric directly into the Dryer chamber. A mechanism advances the rolled sheet of Fabric Softener and releases a sheet so that an Individual will not have to do perform this task manually.

BRIEF DESCRIPTION OF DRAWING

FIG. #1

Figure 1:
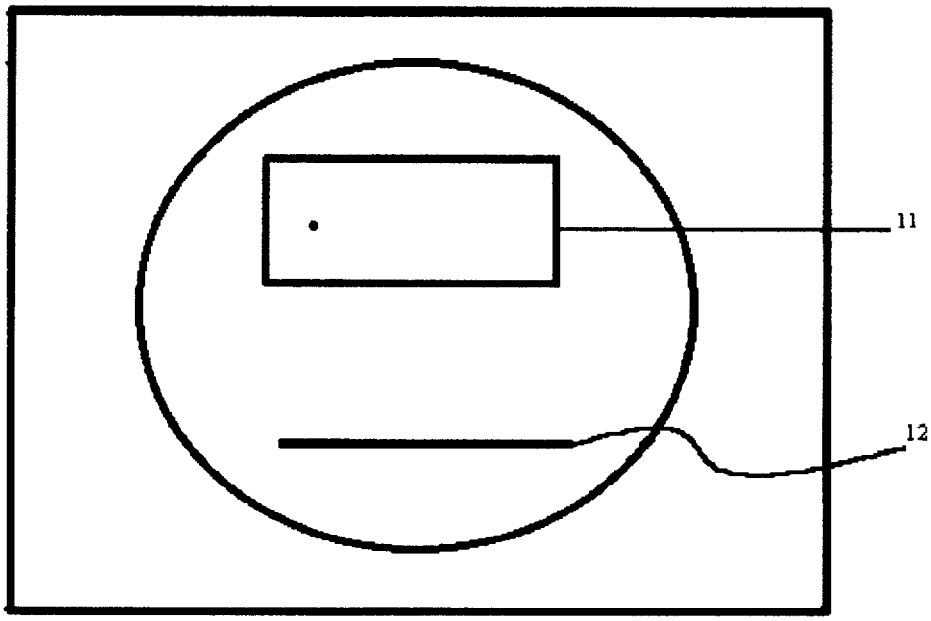
Figure 2:
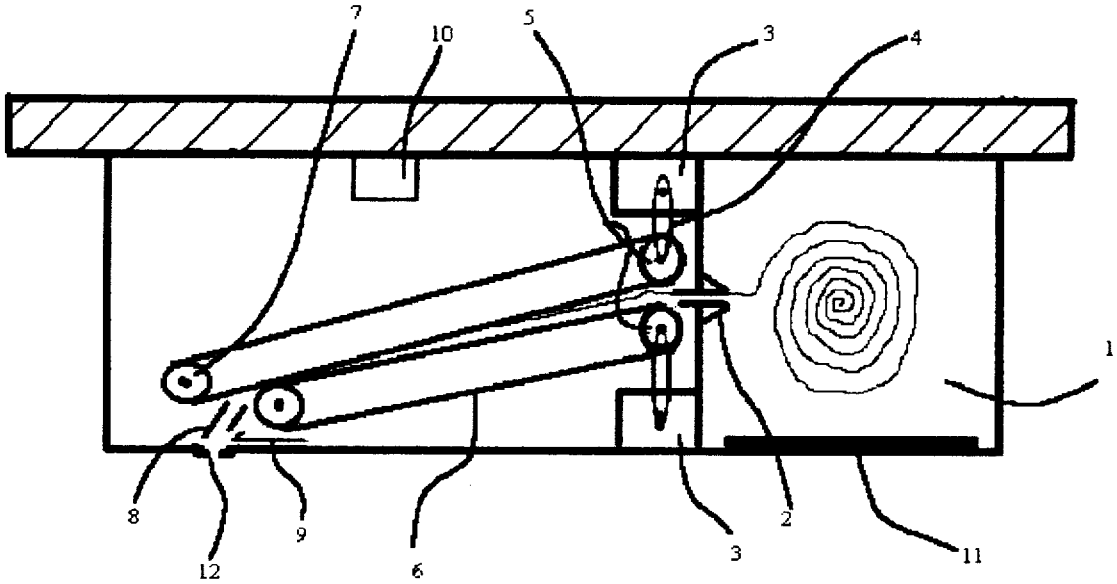

In this FIG. #11 is the door in which can be opened or closed to refill with a new roll.

In figure one #12. The outlet, a rectangle hole located at the bottom of the dryers door will allow a sheet to enter the dryers chamber.

FIG. #2

The invention comprises of a small mechanical device with two compartments. (As shown in FIG. #2.)

#1. The filling chamber is a space which a roll is stored. #2. The sheet guide is guided into the unraveling process. #3. A pair of small electrical motors. The motors will turn #4. #4 are small narrow belts that will in return circulate #5 (entry rollers) #6 wider belt is wrapped around the entry and exit rollers. Exit rollers part #7 will spin freely in conjunction with starter rollers. #8 The outlet guide. The outlet guide guides the sheet out of the center of the dryers door and allows it to enter the dryers tumbling chamber. #9 The cutter. The cutter will release the sheet and allow the sheet to spin around with the clothes. #10 The power supply. The power supply will supply power to the mini electronic motors.

DETAILED DESCRIPTION OF INVENTION

The fabric softener sheet dispenser is located in the dryer door. At the top part of the door there is a filling compartment, the new rolls are installed in the filling door that can be opened or closed with easy access to the rolls. After installing a new roll you must feed the roll into the inlet. The roll now enters the mechanism that will dispense a single sheet into the drying chamber. The roll will be unravelled automatically as the two motors with (belt drive) turn the sheet rollers in a single revolution. In return another belt will pull the sheet through to the bottom of the door. (Allowing a single sheet to be dispensed.) The dispenser will then advance a sheet through the outlet meanwhile being cut by a cutting blade and set free into the drying chamber.

The fabric softener sheet dispenser is a clean and mess free device. With the fabric softener sheet dispenser, an individual only must renew the roll once a month or when running out, with a mess free softener environment.

What I claim as my invention:

1. A clothes dryer fabric softener sheet dispenser comprising:

a fabric softener sheet dispenser mounted on a door of a clothes dryer;

a filling chamber in said dispenser holding a roll of fabric softener sheets;

a sheet guide inside said filling chamber guiding said sheets away from said filling chamber;

a pair of electric motors allowing the driving of said sheets away from said sheet guide and allowing the driving of said sheets away from said filling chamber toward a dryer compartment of said clothes dryer;

belts for engaging said sheets driven from said sheet guide facilitating movement toward said dryer compartment;

entry rollers at an engaging sheet guide end connected to said belts and driven by said electric motors;

exit rollers at an outlet end adjacent said dryer compartment connected to said belts and driven by said electric motors via said belts;

a cutter allowing said fabric softener sheet to enter said dryer compartment and tumble with a circulating air flow inside said clothes dryer.

* * * * *